United States Patent [19]

Miura et al.

[11] Patent Number: 5,025,236

[45] Date of Patent: Jun. 18, 1991

[54] CIRCUIT BREAKER

[75] Inventors: Masao Miura; Naoshi Uchida; Tatsunori Takahashi; Kouji Asakawa; Eiji Nozawa, all of Kanagawa, Japan

[73] Assignee: Fuji Electric Co., Ltd., Kanagawa, Japan

[21] Appl. No.: 572,467

[22] Filed: Aug. 27, 1990

[30] Foreign Application Priority Data

Sep. 7, 1989 [JP] Japan ..... 1-232068
Mar. 20, 1990 [JP] Japan ..... 2-71071
May 31, 1990 [JP] Japan ..... 2-142225

[51] Int. Cl.[5] ..... H01H 75/00

[52] U.S. Cl. ..... 335/46; 335/8; 335/202

[58] Field of Search ..... 335/8–10, 335/22, 46, 202, 167–172, 185–191

[56] References Cited

U.S. PATENT DOCUMENTS 4,166,988 4/1978 Ciarcia et al. ..... 335/9
4,350,965 9/1982 Norden ..... 335/46
4,409,573 10/1983 DiMarco et al. ..... 335/16
4,862,125 8/1989 Maier et al. ..... 335/202
4,891,617 1/1990 Beatty et al. ..... 335/46

*Primary Examiner*—Leo P. Picard
*Assistant Examiner*—Lincoln Donovan
*Attorney, Agent, or Firm*—Finnegan, Henderson, Farabow, Garrett and Dunner

[57] ABSTRACT

The present invention is directed toward a circuit breaker having an open-and-close shaft; holding member coupled to the open-and-close shaft; at least one movable contactor coupled to the holding member; support member for rotatably supporting the open-and-close shaft; and stopper member coupled with the support member so as to restrict an open-and-separation position of the movable contactor, wherein the circuit breaker is disposed within a case, the stopper member are formed on side faces of between-phase partitions of the case and a portion of the holding member contacts the stopper member. Thereby, it is possible to improve an insulation function and to lessen the impact between the holding member and the stopper member.

8 Claims, 6 Drawing Sheets

CIRCUIT BREAKER

BACKGROUND OF THE INVENTION

1. Field of Invention

This invention relates to a small size circuit breaker such as ones installed in distribution lines.

2. Description of Related Art

FIG. 8 shows the general construction of a circuit breaker (breaker for three-pole or phase wirings) and respective parts are housed in a housing made of a plastic molding consisting of a case 1 and a cover 2 covering the case 1. When the breaker is closed as shown, current flows through a stable contactor 3 used also as a terminal connected to an electric source, a movable contactor 4, a lead wire 5, a connector plate 6, an overcurrent tripping device 7, a conductor 8 and a terminal to a load.

The movable contactors 4 respectively are held in respective holders 10 of plastic moldings. These holders 10 are connected to each other by means of an open-and-close shaft 11 integrally formed. The open-and-close shaft 11 is fitted into a U-shaped groove (not shown) formed in a partition 1*a* situated between phases of the case 1 and rotatably held in the groove. In particular, the open-and-close shaft 11 fitted in the U-shaped groove has flanges of insulating barriers which are fitted in grooves formed in the circumference edges of the U-shaped groove.

The movable contactor 4 is driven to open and close the circuit by an open-and-close mechanism 12 through the holders 10. The open-and-close mechanism 12 is held at its set condition shown when a latch 14 held on a frame 13 provided with side plates at both sides of the movable contactor 4 engages with a latch receiver 15. As seen in FIG. 8, the latch receiver 15 has a clockwise from the latch 14 and is prevented from rotating by means of a claw 17 of a trip cross bar 16 engaged with the back face of the latch receiver 15.

In addition, the open-and-close shaft 11 fitted in the between-phase-partition 1*a* of the case 1 is pressed so as to prevent from floating-up or rising by a holder presser 18 formed on the frame 13 by outward being a part of the frame 13. The frame 13 is made of an iron plate piece and shaped in a U-shape as shown in FIG. 10. The frame 13 is threadly secured to a supporting board (not shown) of the case 1 by means of a bottom plate 13*a* connecting left and right side plates and attachment pieces 13*b* formed by cutting and bending parts of the side plates at the opposite end from the bottom plate 13*a*. A reference numeral 13*c* is a hole through which a support shaft of the latch receiver 15 passes and 13*d* is an open hole or groove through which a support shaft of the latch 14 and the like passes.

Under this condition, flowing overload current and short-circuit current activates the overcurrent tripping device 7 to rotate the trip cross bar 16 counterclockwise so as to disengage the claw 17 from the latch receiver 15. Accordingly, the latch receiver 15 rotates clockwise and disengages from the latch 14. The movable contactor 4 opens and moves to the position shown by broken lines due to a motion of the open-and-close mechanism 12 and stops at the position above.

By the way, it is necessary to keep or hold the movable contactor 4 with a predetermined distance of separation when the circuit breaker open. Consequently, according to the conventional technology, a stopper 19 is formed on the cover 2 as shown or a stopper on the frame 13 supporting the open-and-close mechanism 12. The movable contactor 4 strokes such stopper when the contactor reaches its end position of a separation travel. However, the movable contactor 4 deforms when it is considerably heated due to a large-current breaking of the circuit breaker and then strikes a stopper. According to the conventional breaker provided with a frame 12 and a stopper formed on the frame, there is a danger that the latch 14 is disengaged from the latch receiver 15 or the latch receiver 15 is disengaged from the claw 17, resulting in a tripped condition of the circuit breaker.

A proposed solution to the aforementioned problem is described Japanese Utility Model Unexamined Application No.59-178843, in which an arm used also as an insulation barrier is integrally formed on the open-and-close shaft 11 to be fitted in the U-shaped groove of the case partition; a groove containing the arm is formed in the circumference edge of the groove; and the arm engages with a circumferential wall of the groove when the movable contactor opens in order to restrict an open position of the movable contactor.

Such construction of the breaker will be explained again briefly with reference to FIG. 9. Here, FIG. 9(A) is a side view of the U-shaped groove portion and FIG. 9(B) is a sectional view along the B—B line in FIG. 9(A). It is apparent that the same reference numerals used to the parts in FIG. 8 are used to the corresponding parts of FIGS. 9(A) and (B). In the drawings, 1*a* shows a between-phase partition of the case 1, 20 is a U-shaped groove formed in the between-phase partition, 21 is a groove formed on the circumferential edge of the U-shaped groove 20, 11 is an open-and-close shaft fitted in the U-shaped groove 20, 22 is an arm used also as an insulation barrier formed integrally to the open-and-close shaft 11 and contained in the groove 21, and 23 is a piece used to fill up spaces on the upper portions of the grooves 20, 21 and to lengthen an insulation distance. In a condition in which the movable contactor opens as shown, the arm 22 engages, through its end, with the circumference wall 21*a* of the groove 21 so as to restrict an open position of the movable contactor.

According to the construction above, the arm 22 has a thicker wall than that of a mere insulation barrier so as to make the arm bearable to a large striking force or impact when the movable contactor is opened. The thickness or width size of the groove 21 containing the arm 22 is limited because the groove is formed in a range of the thickness measurement of the between-phase partition 1*a*. The arm 22 is also limited in its thickness. As a result, the end portion of the arm 22 touching the circumference wall 21*a* is apt to be collapsed and a touching face of the circumference wall 21*a* is easy to become depressed or caved in.

When a collapse is generated on the arm 22 and a cave in is formed on the circumferential wall 21*a*, sliding resistance between the arm 22 and the circumferential wall 21*a* increases when the open-and-close shaft 11 is rotated along the opposite direction to rotate the movable contactor from its open condition to a closed condition. Rotation resistance of the open-and-close shaft increases because abrasion dust or powder of the arm 22 and the partition wall 1*a* collects between the open-and-close shaft 11 and the U-shaped groove 20, resulting in an increase of necessary load. In addition, because the stoppage position of the arm 22 changes, an open position of the movable contactor 4 and a rotation angle of the holder 10 changes, so that the movable contactor 4 interferes disadvantageously with construction parts of the open-and-close mechanism. Consequently, operations of internal accessories, for example supplemental switches to be operated by rotations of the holder 10 are adversely affected.

As described above, according to the conventional example shown in FIG. 9, the width of the groove 21 is limited in selection, so that the arm 22 fills the full width of the groove 21 as shown in FIG. 9(B) and there is substantially no space allowance in the width direction of the groove 21. Consequentially, the piece 23 to be fitted in the between-phase partition 1*a* can not enter the gap G between the side wall of the groove 21 and the side face of the arm 22, resulting in its covering only the upper face of the arm 22 and the open-and-close shaft 11 as shown. As a result, a triangle gap 24 is generated between the piece 23 and the open-and-close shaft 11 as shown in FIG. 9(A) depicting a side view of the U-shaped groove 20 resulting in some troubles about insulation between phase when big current, such as short-circuit current is open. In addition, it is difficult to make, by a plastic molding process, the piece 23 having a sharp end filling-up the gap 24, so that there is a possibility of chipping the sharp end during a handling of the piece if it is managed to make the sharp end.

Again, as shown in FIG. 8, the open-and-close shaft 11 is held under pressure so as not to rise by a holder presser 18 formed on a part of the frame 13 supporting the open-and-close mechanism 12. According to this construction, when the breaker opens and closes, impact generated in the movable contactor 4 upon closure of the breaker is transferred to the frame 13 through the open-and-close shaft 11. Consequently, the engagement among the latch 14 supported by the frame 13, the latch receiver 15 and the claw 17 is disengaged resulting in the failure of the failure to close. In order to avert this danger, the frame 13 is strengthened by increasing the thickness and width thereof. The force of the return spring 25 of the trip cross bar 16 may also be increased. Nevertheless, the more the frame 13 strengthens, the more a size of the case 1 enlarges disadvantageously, and when the force of the return spring 25 enlarges, the overcurrent tripping characteristic deteriorates.

Concerning FIG. 8, current flows through the stable contactor 3 and the movable contactor 4 in opposite directions. Consequently, magnetic forces repelling each other are generated in both the currents. The circuit breaker is constructed so as to use the magnetic repulsion, when a large current, such as a short-circuit current flows, driving rapidly the movable contactor 4 along its opening direction. However, very large bending stress making the holder presser 18 a fulcrum is generated in the open-and-close shaft 11. Accordingly, in order to prevent the shaft 11 from being broken by the bending stress, it is necessary to thicken or increase a diameter of the shaft or use a strong material of the shaft resulting in a large and expensive case 1.

SUMMARY OF THE INVENTION

An object of the present invention is to provide a circuit breaker in which an open-and-separation position of the movable contactor is restricted by an engagement of the holder and the case partition in order to evade impacts to the movable contactor and the frame supporting the open-and-close mechanism when the movable contactor opens. Another purpose is to reduce damage of the holder and engagement portions of between-phase partitions, and at the same time to maintain insulation efficiency between phases.

An additional object of the present invention is to provide a circuit breaker in which no impact is applied to the frame supporting the open-and-close mechanism when the breaker opens by relieving stress applied to the open-and-close shaft due to a magnetic repulsion generated between the contactors when a large current flows is relieved.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in tho appended claims.

To achieve the objects and in accordance with the purpose of the invention, as embodied and broadly described herein, the invention comprises an open-and-close shaft; holding means coupled to the open-and-close shaft; at least one movable contactor coupled to the holding means; support means for rotatable supporting the holding means; and stopper means are coupled with the support means so as to restrict an open-and-separation position of said movable contactor.

The present invention provides a circuit breaker in which, on the holders of respective phases mutually connected by the open-and-close shaft, each movable contactor is held, and these holders are rotatable supported in the case by fitting the open-and-close shaft into the U-shaped groove of the between-phase partition of the case. In order to attain the first purpose, a stopper is formed on the side face of the between-phrase partition of the case in order to restrict the open-separation position of the movable contractor by making a part of the holder contact the stopper.

Thus, a damper is installed to the stopper extruding from the contact face contacting holder. It is therefore possible to lessen the impact between the holder and the stopper by contacting the holder with the contact face after the holder strikes the damper during the breaker opening.

In addition, in order to attain the second purpose, the present invention is adapted to fit a piece covering the open-and-close shaft into the U-shaft groove and press the piece through a cover covering the case.

Positional restriction of the movable contactor due to an engagement of the holder with the stopper on the side wall of the between-phase partition prevents damage of the movable contactor and impact to the supporting frame of the open-and-close mechanism. Moreover, because the insulation barrier fitted into the groove formed in the between-phase partition serves the sole purpose of, the thickness of the barrier can be reduced. It is possible to make some space or allowance along the width direction of the insulation barrier contained in the groove and to insert a piece in the space, resulting in an increase of insulation of the barrier.

Furthermore, it is possible to effectively prevent the circuit breaker from erroneously operating due to impact by installing a damper on the stopper to which the holder contacts, and making the holder contact with the stopper after the holder strikes the damper so as to damp kinetic energy of the holder, thereby restricting an open-and-close position. And it is possible to lessen a burden of the contact portion improving a positional precision.

The piece is fitted into the U-shaped groove so as to cover the open-and-close shaft and the cover presses the shaft through the piece. Consequently, impact due to opening and closing operations of the breaker is not directly applied to the frame. By pressing the open-and-close shaft through the piece fitted to the between-phase partition, it is possible to press the shaft through its portion nearer to the movable contactors of left and right phases than another position. When the shaft is pressed is in this position or held through side plates of the frame positioned inside of the between-phase partition, a bending stress, due to magnetic repulsion and generated in the shaft, is reduced. In addition, the contact face between the piece and the open-and-close shaft has a wider width than that of the side plates of the frame and it is easy to make the shape of the contact face arc-shaped, so that rotation of the shaft is made smooth and the chance of scarring on the bearing faces of the shaft decreases. Furthermore, an installation of the piece to the U-shaped groove formed on the between-phase partition enables to fill-up the gap between phases improving an insulation function.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
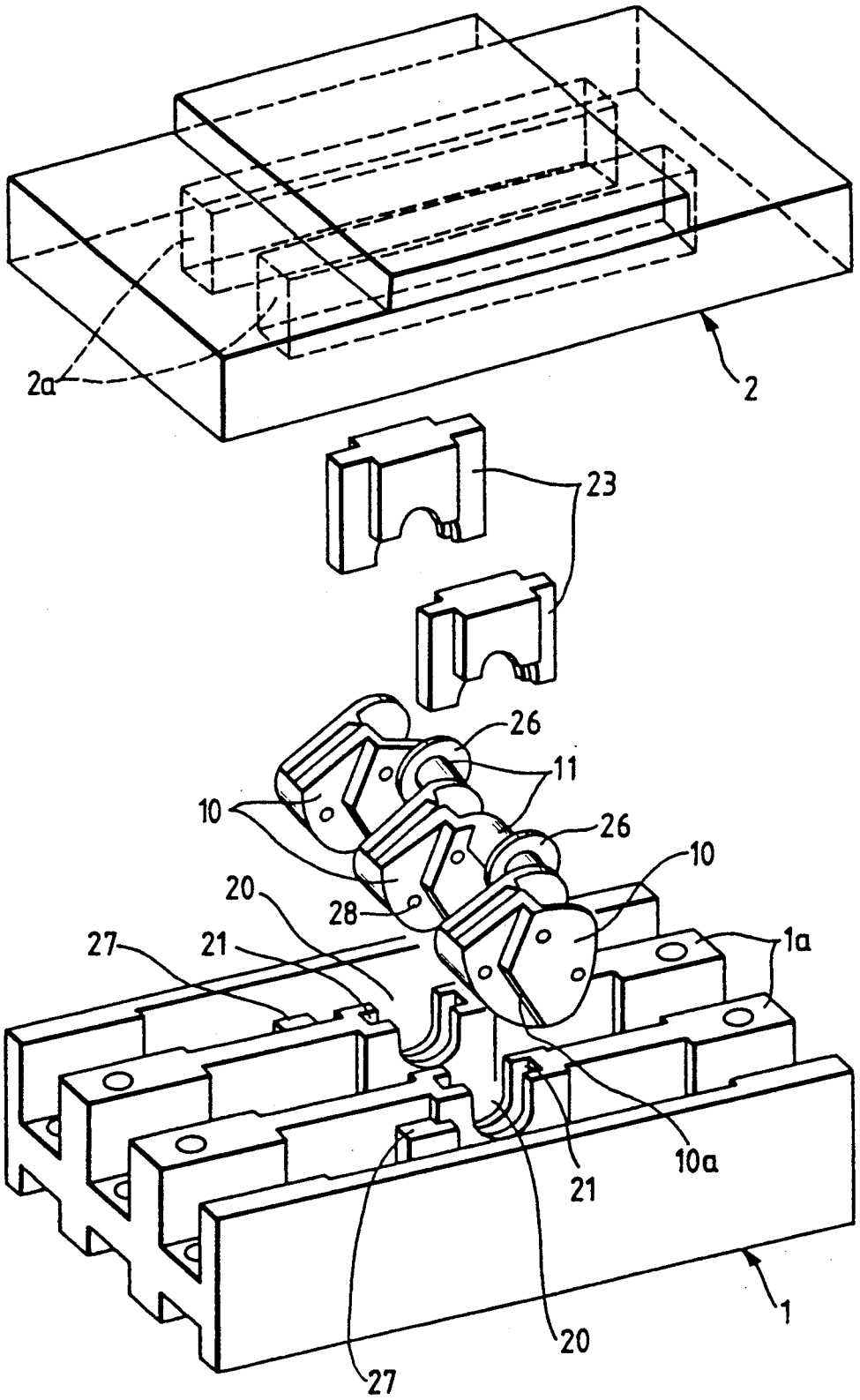
FIG. 1 is an exploded perspective view of the important portion of one embodiment according to the present invention.

FIG. 1 is an exploded perspective view of the important portion of the three-phase circuit breaker. In FIG. 1, the holders 10 are made of molded plastic forms. Holders 10 hold the movable contactors (not shown) of each phase. The respective phases are mutually connected by the integrally-formed open-and-close shaft 11. At the center of the shaft 11 a flange-like insulation barrier 26 is integrally formed. The holder 10 has a fork-end portion formed by connecting left and right side walls through an arc-shaped bottom. The movable contactor (not shown) is held by a pin extending through the side plates of the contactor.

While, the case 1 of a plastic molding is divided into isolated chambers for three phases by between-phase partitions 1*a*. Wires or leads for respective phase (not shown) are contained in each isolated chamber. The between-phase partition 1*a* has the U-shaped groove 20 formed on the upper face of the partition and the open-and-close shaft 11 for connecting holders 10 fits in the groove 20. A groove 21 for containing the insulation barrier 26 is formed on the circumference edge of the U-shaped groove 20. Furthermore, on the outside faces of the between-phase partition 1*a*, square stoppers 27 are integrally formed so as to restrict the open-and-separation position of the movable contactor after a part of the holder 10 butts or contacts the stopper 27.

A stepped portion 10*a* is formed on the side face of the holder which is adapted to contact the stopper 27 of the between-phase partition 1*a* when the movable contactor is opened and separated as will be described. It is noted that 28 is hole through which a pin connecting a toggle link of the open-and-close mechanism and the holder 10 phases.

Figure 2A:
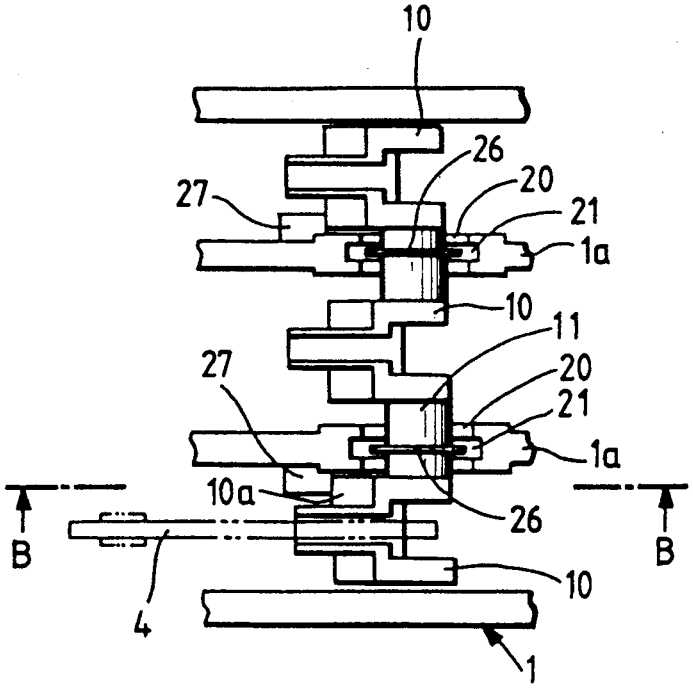
FIG. 2(A) is a plan view of the important portion, showing a condition of the holder supported on the case.
Figure 2B:
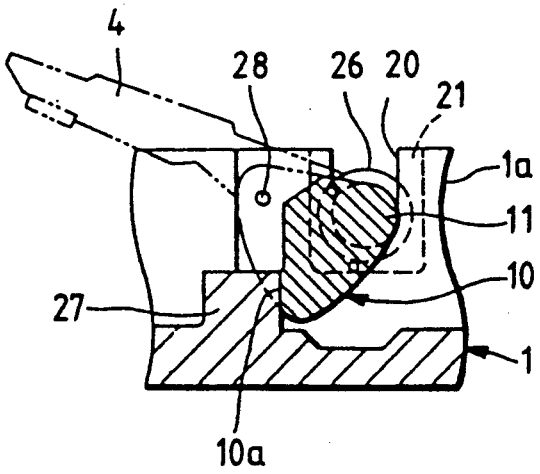
FIG. 2(B) is a section along the line B—B shown in the plan view.

FIG. 2 depicts a condition of the case 1 on which the holder 10 is supported. FIG. 2(A) is a plan view of important parts and FIG. 2(B) is a section along the line B—B shown in FIG. 2(A). As shown in the figures, the open-and-close shaft 11 is fitted in the U-shaped groove 20 formed in the between-phase partition 1*a* and the holder 10 and is rotatably supported by the case 1. The insulation barrier 26 is fitted into the groove 21 formed at the groove 21 of the U-shaped groove 20. The figure shows the movable contactor 4 by two-point broken lines, which is in its open position. In this condition, the stepped portion 10*a* at side face of the holder 10 contacts the extrusion 27 of the between-phase partition 1*a*, thereby restricting the open position of the movable contactor 4.

According to the above an engagement of the holder 10 and the stopper 27 is carried out outside of the between-phase partition, so that the engagement portions thereof have sufficient the thickness without restriction of the width of the partition 1*a*. In addition engagement portions are prevented from being crushed or dented.

Figure 3A:
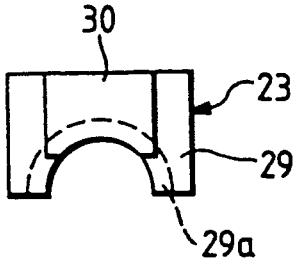
FIG. 3(A) shows a side elevation view of the piece.
Figure 3B:
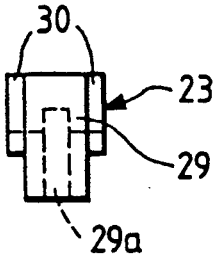
FIG. 3(B) shows its front view.

FIG. 3 shows a piece to be fitted into the U-shaped groove 20 of the between-phase partition 1*a*, of which FIG. 3(A) is a side elevation view and FIG. 3(B) is a front view of the piece. As shown in FIGS. 3(A) and (B), the piece 23 consists of a body portion 29 to be inserted into the groove 21 and wing portions 30 to be inserted to the U-shaped groove 20. Both the body portion and the wing portions have arc-shaped cut-out portions which are applied to the open-and-close shaft 11. The arc-shaped surface of the body portion 29 has a groove 29*a* in which the insulation barrier 26 is positioned.

Figure 4A:
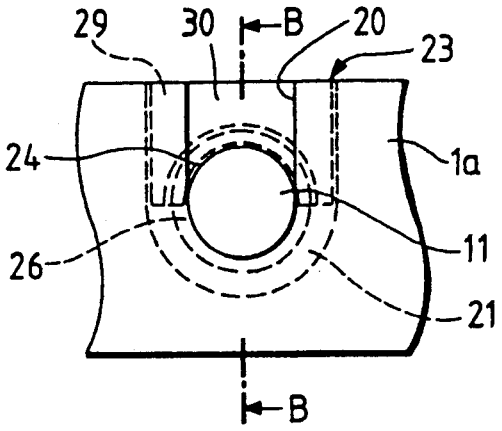
FIG. 4(A) is a side elevation view showing the piece of FIG. 3 which is fitted in the between-phase partition depicted in FIG. 2.
Figure 4B:
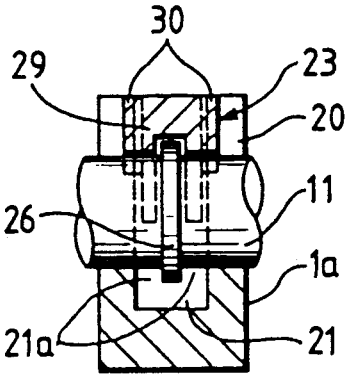
FIG. 4(B) is a section along the line B—B of FIG. 4(A).

FIG. 4(A)is a side view and FIG. 4(B) is a section along the line B—B shown in FIG. 4(A), each figure showing the important portion of the between-phase partition 1*a* in which portion the piece 23 fits. Along the width direction of the insulation barrier 26 inserted into the groove 21 of the between partition 1*a*, there is a vacant space shown in FIG. 4(B) into which the body portion 29 of the piece 23 is inserted in order to cover the upper-half portion of the insulation barrier 26. Consequently, the triangle gap 24 generated in the conventional structure shown in FIG. 7 is filled-up by the body portion 29.

Returning to FIG. 1, the cover 2 has between-phase partitions 2*a* corresponding to the between-phase partitions 1*a* of the case 1. The bottom faces ofthe partitions 2*a* are adapted to intimately contact the top faces of the partitions 1*a* of the case 1 when the over 2 is installed on the case 1. As a result, the piece 23 fitted into the U-shaped groove 20 is pressed and held by the between-phase partition 2*a* and the open-and-close shaft 11. The open-and-close shaft 11 is pressed through the piece 23.

Figure 5:
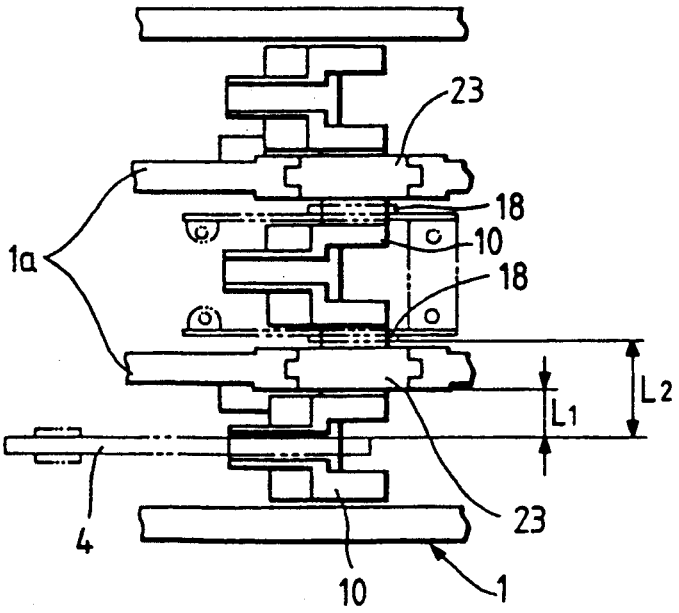
FIG. 5 is a plan view of the important portion in order to compare the distances from the movable contactor of left and right poles to the pressing points of the open-and-close shaft.
Figure 8:
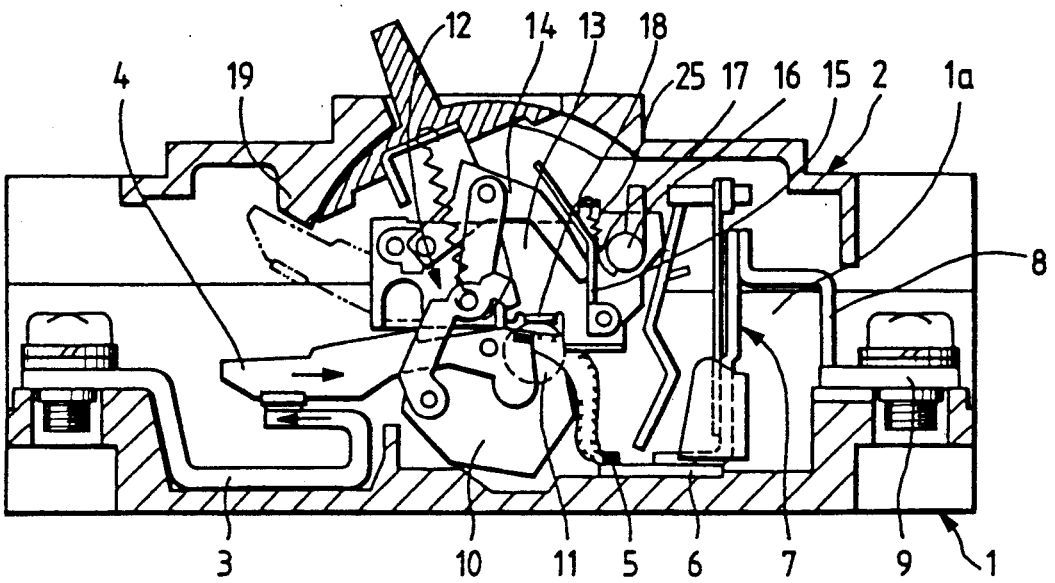
FIG. 8 is a transversal section showing the conventional example.
Figure 9A:
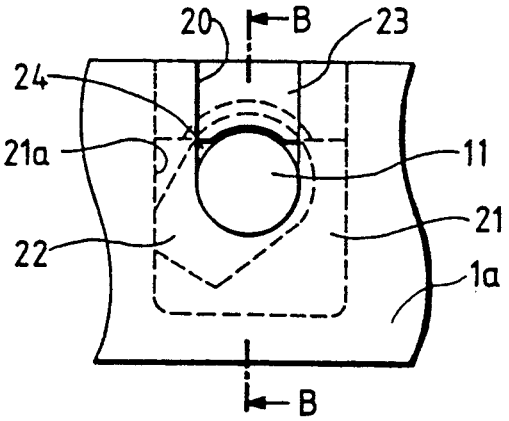
FIG. 9(A) is an enlarged side view of the important portion of the conventional example.
Figure 9B:
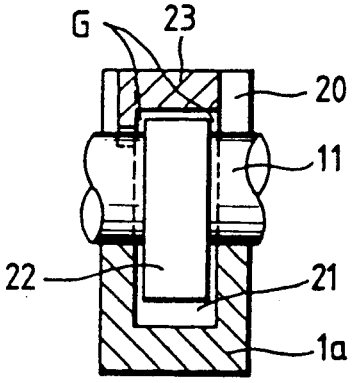
FIG. 9(B) is a section taken along the line B—B of the previous view.
Figure 10:
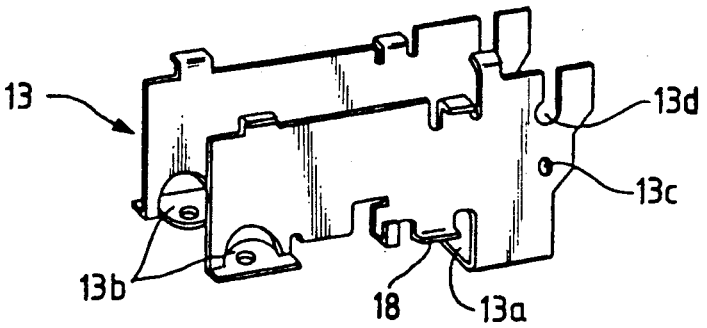
FIG. 10 is a perspective view of the frame shown in FIG. 8.

FIG. 5 is a plan view comparing the case in which the piece 23 presses the open-and-close shaft 11 to another case in which the conventional holder presser 18 presses the shaft 11. The frame 13 of FIG. 8 is also shown by two-points broken lines. Referring to FIGS. 5, 8, 9(A), and 9(B), let a distance $L_1$ be defined as the distance from the movable contactor 4 of the left and right poles to the piece 23. Let a distance $L_2$ be defined as the distance from the movable contactor 4 to the holder presser 18. Clearly, $L_2$ is larger than $L_1$ in FIG. 5 and not in FIGS. 8, 9(A), and 9(B) because the holder presser 18 is placed within or between the between-phase partition 1*a*. Consequently, due to magnetic repulsion effective to the movable contactor 4, the bending stress of the open-and-close shaft 11 becomes smaller in the circuit breaker according to an embodiment of the present invention shown in FIG. 5 in which the piece 23 presses the open-and-close shaft 11 than in the conventional circuit breaker shown in FIG. 8.

Figure 6:
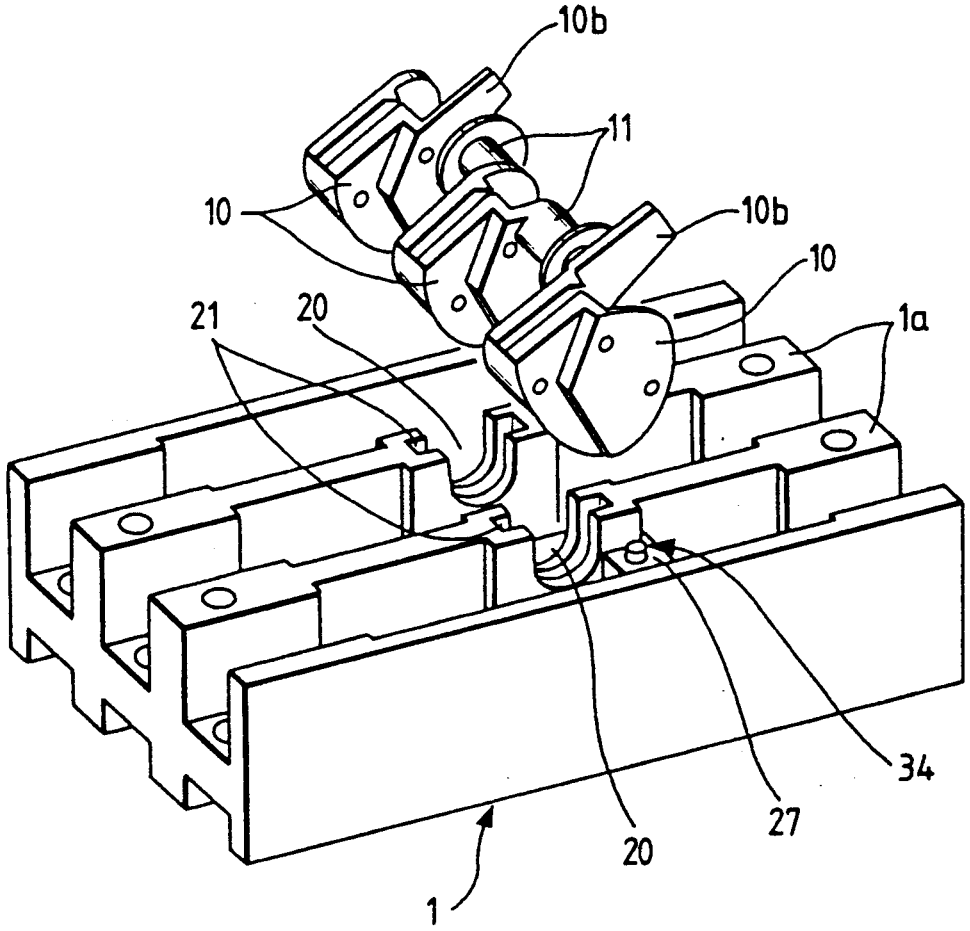
FIG. 6 is an exploded perspective view of another embodiment of the present invention.

Furthermore, according to the structure in which structure the cover 2 presses the open-and-close shaft through the piece 23, no impact generated when the breaker opens and closes is directly transferred to the frame 13. Consequently, mutual engagement between the latch 14 supported by the frame 13, the latch receiver 15, and the claw 17 of the trip cross bar 16, as shown in FIG. 6. Furthermore, the piece 23 functions as a bearing enabling the open-and-close shaft 11 to rotate smoothly and the gap between the phases to disappear resulting in an improvement of insulation property.

Figure 7A:
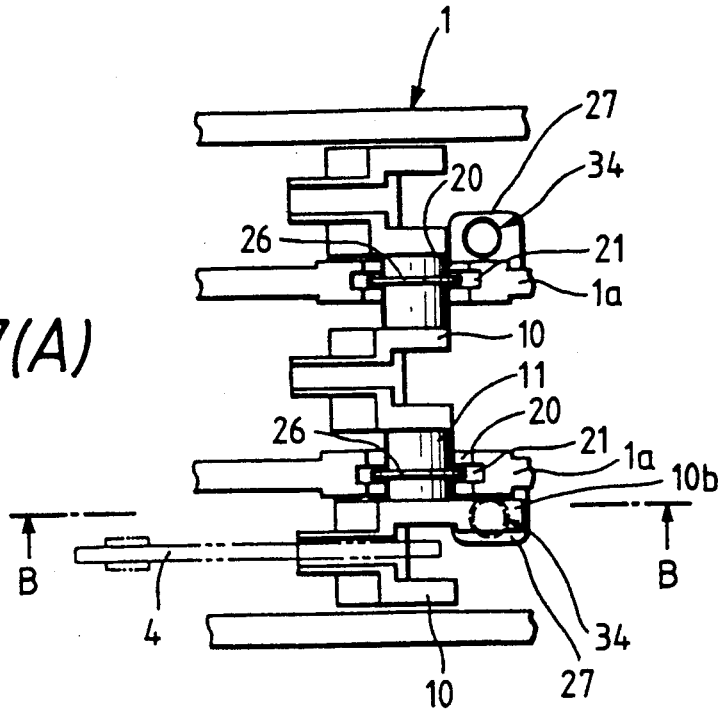
FIG. 7(A) is a plan view of FIG. 6.
Figure 7B:
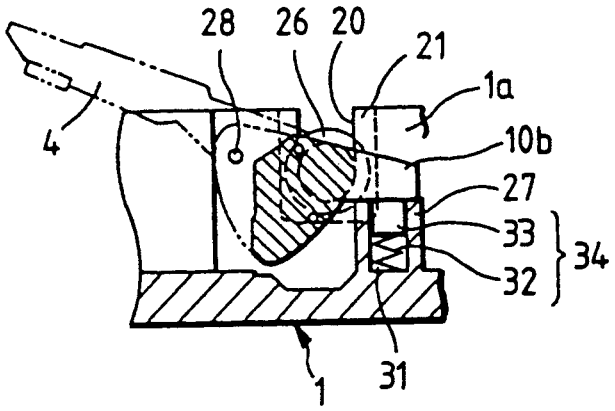
FIG. 7(B) is a section taken along the line B—B of the previous view to show the open-and-separation condition.

Next, FIGS. 6 and 7 respectively show another embodiment having a damper installed on the stopper to which the holder is butted. FIG. 6 is an exploded perspective view of the important portion. FIG. 7(A) is a plan view of the important portion. FIG. 7(B) is a section along the line B—B depicting an open-and-separation condition, and FIG. 7 (C) is similar to FIG. 7(B) but depicting a close condition. The parts shown in FIGS. 6 and 7 and corresponding to these of the previous embodiment shown in FIG. 5 have the same reference numerals.

Figure 7C:
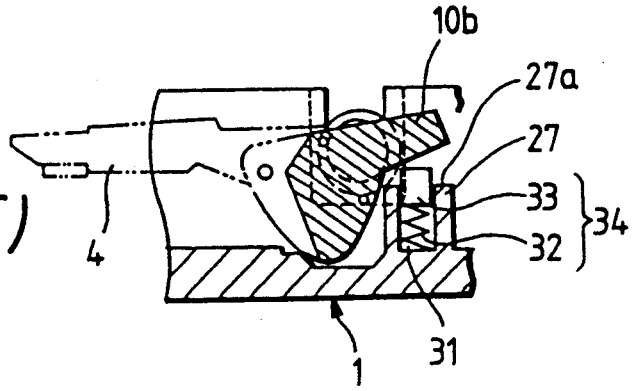
FIG. 7(C) is a similar section showing the close condition.

In FIG. 6, the holder 10 has a protrusion 10*b* extending rearward (to load side) and being formed integrally with the side wall. The side face of the case partition 1*a* has the stopper 27 integrally formed thereon, with which stopper the protrusion 10*b* coming into contact when the movable contactor 4 separates and opens. The stopper 27 has a vertical, bottomed and cylindrical opening 31 containing a damper 34 consisting of a compression spring 32 and a rubber shock absorber 33. The shock absorber 33 is supported by the spring 32 and placed at its floating or raised position from a butting face 27*a* of the stopper 27 when the movable contactor 4 is closed as shown in FIG. 7(C).

When the movable contactor 4 moves from its closed condition to the open condition, the protrusion 10*b* first collides with the shock absorber 33 to press down against the spring 32 and then stops after contacting the stopper 27 as shown in FIG. 7(B). According to the construction, kineticenergy of the holder 10 and the movable contactor 4 is absorbed by the damper 34 before the protrusion 10*b* contacts the stopper 27, so that the protrusion 10*b* slowly contacts the stopper 27 and stops. As a result, on the protrusion 10*b* and the stopper 27 are damaged less than in the conventional system. The design criteria of these parts is less critical than in the conventional system, and consequently these parts can be miniaturized.

According to the invention, providing the protrusion at the side face of the between-phase partition and restricting the open position of the movable contactor by an engagement of a part of the holder with the protrusion prevent the movable contactor from being damaged due to contact between the movable contactor and the stopper. Providing the stopper on the frame of the open-and-close mechanism prevents the movable contactor from being tripped accidently.

In the conventional system a gap can form when the insulation barrier, arm, and between-phase partition are engaged, thereby causing a reduced insulative property. According to the present invention, however, the insulative property between phases is not diminished due to this gap. Because such engagement between the holder and the stopper is carried out outside of the case partition, it is possible to sufficiently thicken the engagement portions, thereby strengthening them and to provide the damper relieving shock.

Furthermore, in compliance with the present invention, the piece fitted into the U-shaped groove of the between-phase partition is pressed by the cover so as to hold firmly the open-and-close shaft, so that a tripped condition is prevented. In the conventional system this tripped condition is due to impacts generated when the frame supporting the open-and-close mechanism holds the open-and-close shaft. In the conventional system, the tripped condition can result from a bending stress due to magnetic repulsion generated in the shaft. In the present invention, this bending stress is reduced. In addition, in accordance with the present invention, fitting the piece to the between-phase partition makes rotation of the open-and-close shaft smooth and improves between phase insulation property.

It will be apparent to those skilled in the art that various modifications and variations can be made in the circuit breaker of the present invention and in construction of this circuit breaker without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims and their equivalents.

What is claimed is:

1. A circuit breaker comprising:

an open-and-close shaft;

holder means for holding a movable contactor, said holder means being coupled to said open-and-close shaft;

support means for rotatably supporting said open-and-close shaft;

and stopper means for stopping said open-and-close shaft, said stopper means being coupled with said support means so as to restrict an open-and-separation position of said movable contactor, wherein said circuit breaker is disposed within a case, said stopper means are formed on side faces of between-phase partitions of said case and a portion of said holder means contacts said stopper means.

2. The circuit breaker of claim 1 wherein said circuit breaker is provided for a plurality of poles of a wiring.

3. The circuit breaker of claim 2 wherein said holding means are provided for each of said poles.

4. The circuit breaker of claim 1 wherein said support means comprises U-shaped grooves formed in a between-phase partition of said case, said open-and-close shaft being fitted into said U-shaped grooves

5. The circuit breaker of claim 1 further comprising damper means installed on said stopper means so as to protrude from a contacting surface of said holder means, said holder means being adapted to butt against a contacting surface of said stopper means after the holder means collides with the damper means during an open-and-separation operation of said circuit breaker.

6. The circuit breaker of claim 4 further comprising a piece that covers said open-and-close shaft which is fitted into said U-shaped groove and said piece is pressed by a cover covering said case.

7. The circuit breaker of claim 1 wherein said stopper means are square.

8. The circuit breaker of claim 5 wherein said damper means comprises a compression spring and a rubber shock absorber.

* * * * *